US009370249B2

(12) United States Patent
Warncke et al.

(10) Patent No.: US 9,370,249 B2
(45) **Date of Patent: *Jun. 21, 2016**

(54) CHAIR WITH COUPLING COMPANION STOOL BASE

(71) Applicant: Sauder Manufacturing Co., Archbold, OH (US)

(72) Inventors: Anthony J. Warncke, Archbold, OH (US); Jeffrey A. Jameson, Archbold, OH (US); Thomas A. Hagerty, Somerville, MA (US)

(73) Assignee: Sauder Manufacturing Co., Archbold, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/596,623

(22) Filed: Jan. 14, 2015

(65) Prior Publication Data

US 2015/0130230 A1 May 14, 2015

Related U.S. Application Data

(63) Continuation of application No. 14/057,781, filed on Oct. 18, 2013, now Pat. No. 8,960,787, which is a continuation of application No. 13/277,778, filed on Oct. 20, 2011, now Pat. No. 8,585,136, which is a continuation of application No. 11/877,478, filed on Oct. 23, 2007, now Pat. No. 8,083,288.

(60) Provisional application No. 60/853,669, filed on Oct. 23, 2006.

(51) Int. Cl.

| | |
|---|---|
| ***A47C 7/42*** | (2006.01) |
| ***A47C 3/20*** | (2006.01) |
| ***A47C 13/00*** | (2006.01) |
| ***A47C 7/00*** | (2006.01) |
| ***A47C 3/029*** | (2006.01) |
| ***A47C 4/02*** | (2006.01) |

(52) U.S. Cl.

CPC ..... *A47C 13/00* (2013.01); *A47C 3/029* (2013.01); *A47C 3/20* (2013.01); *A47C 4/02* (2013.01); *A47C 7/004* (2013.01); *A47C 7/42* (2013.01)

(58) Field of Classification Search

USPC ..... 297/119, 130, 133, 134, 258.1, 271.6, 297/440.15, 440.22

See application file for complete search history.

(56) References Cited

U.S. PATENT DOCUMENTS

| | | | |
|---|---|---|---|
| 794,461 | A | 7/1905 | Mackey |
| 1,298,053 | A | 3/1919 | Kennedy |
| D139,241 | S | 10/1944 | Wright |

(Continued)

*Primary Examiner* — Timothy J Brindley

(74) *Attorney, Agent, or Firm* — McGarry Bair PC

(57) ABSTRACT

A chair with a coupling companion stool base includes a frame that has: a claw extending downward from a second portion of a lower portion of the frame; a latch extending downward from and movably connected with a first portion of the lower portion; two legs adapted to support the frame upon a supporting surface extending downward from the lower portion; and a receptacle defined between the claw and the latch. The base supports the frame above a supporting surface and has a saddle with opposite back and front edges and a top surface that faces away from the supporting surface. The top surface may also define at least one of a work surface, a writing surface, and a sitting surface. The base releasably couples with the frame, having the saddle seated in the receptacle, the front edge seated in the claw, and the back edge captured by the latch. When decoupled, the chair portion may be used as casual floor rocker seating.

19 Claims, 12 Drawing Sheets

(56) References Cited

U.S. PATENT DOCUMENTS

| | | | |
|---|---|---|---|
| D153,333 | S | 4/1949 | Arnao |
| 2,530,474 | A | 11/1950 | Lutes |
| 2,535,290 | A | 12/1950 | Ivett |
| 2,545,840 | A | 3/1951 | Browne et al. |
| 2,644,506 | A | 7/1953 | Brand |
| 2,689,598 | A | 9/1954 | Brand |
| 3,223,431 | A | 12/1965 | Gottfried et al. |
| 3,269,771 | A | 8/1966 | Erdos |
| 3,669,497 | A | 6/1972 | Massonnet |
| 3,821,825 | A | 7/1974 | Bailey |
| 4,160,564 | A | 7/1979 | Kyle |
| 4,394,046 | A | 7/1983 | Irwin et al. |
| D272,205 | S | 1/1984 | De Boer |
| D273,729 | S | 5/1984 | Pelly et al. |
| D283,858 | S | 5/1986 | Opsvik |
| 4,697,845 | A | 10/1987 | Kamman |
| 4,723,813 | A | 2/1988 | Kassai |
| 4,736,982 | A | 4/1988 | Hwang |
| 4,765,684 | A | 8/1988 | Kvalheim et al. |
| 4,767,159 | A | 8/1988 | Opsvik |
| 4,767,160 | A | 8/1988 | Mengshoel et al. |
| D297,690 | S | 9/1988 | Opsvik |
| 4,793,655 | A | 12/1988 | Kvalheim et al. |
| 4,832,407 | A | 5/1989 | Serber |
| 5,042,875 | A | 8/1991 | Biggs, Sr. |
| 5,054,857 | A | 10/1991 | Kvalheim |
| D327,375 | S | 6/1992 | Cooper |
| D329,340 | S | 9/1992 | Miller |
| 5,169,210 | A | 12/1992 | Fricano |
| 5,255,957 | A | 10/1993 | Opsvik et al. |
| 5,308,146 | A | 5/1994 | Chou |
| 5,423,597 | A | 6/1995 | Rogers |
| 5,653,499 | A | 8/1997 | Goodall |
| 5,667,278 | A | 9/1997 | Li |
| 5,690,379 | A | 11/1997 | Cayssials |
| D395,962 | S | 7/1998 | Buffon |
| 5,806,922 | A | 9/1998 | Mendelovich |
| D400,365 | S | 11/1998 | Rossi |
| D409,007 | S | 5/1999 | Osterweil-Glaz et al. |
| D411,692 | S | 6/1999 | Ogg |
| 5,947,562 | A | 9/1999 | Christofferson et al. |
| 5,992,932 | A | 11/1999 | Kain et al. |
| D425,713 | S | 5/2000 | Tholkes et al. |
| 6,116,682 | A | 9/2000 | Baur |
| D437,129 | S | 2/2001 | Pinto |
| D437,692 | S | 2/2001 | Smith |
| D439,066 | S | 3/2001 | Hannes et al. |
| 6,352,306 | B1 | 3/2002 | Dreiling |
| 6,367,874 | B2 | 4/2002 | Casini |
| 6,416,123 | B1 | 7/2002 | Bell |
| 6,554,353 | B1 | 4/2003 | Yu |
| 6,572,134 | B2 | 6/2003 | Barrett et al. |
| D478,734 | S | 8/2003 | Chen |
| D479,054 | S | 9/2003 | Chen |
| 6,712,711 | B1 | 3/2004 | Skelton et al. |
| D495,155 | S | 8/2004 | Baldanzi et al. |
| 6,786,553 | B1 | 9/2004 | Grove |
| D497,261 | S | 10/2004 | Epp et al. |
| 6,824,149 | B1 | 11/2004 | Whitlock et al. |
| 6,857,696 | B2 | 2/2005 | Usagani |
| 6,953,222 | B2 | 10/2005 | Larrick et al. |
| D515,831 | S | 2/2006 | Hosoe |
| 7,152,358 | B1 | 12/2006 | LeAnna et al. |
| 7,316,452 | B2 | 1/2008 | Vestweber |
| 7,338,122 | B2 | 3/2008 | Hei et al. |
| D585,204 | S | 1/2009 | Wieland et al. |
| 7,472,955 | B2 | 1/2009 | Crane et al. |
| 8,083,288 | B1 | 12/2011 | Warncke et al. |
| 8,585,136 | B2 | 11/2013 | Warncke et al. |
| 8,960,787 | B2 | 2/2015 | Warncke et al. |
| 2002/0014792 | A1 | 2/2002 | Casini |
| 2002/0074835 | A1 | 6/2002 | Chalender |
| 2003/0218365 | A1 | 11/2003 | Kawiaka |
| 2005/0057079 | A1 | 3/2005 | Lee |

CHAIR WITH COUPLING COMPANION STOOL BASE

CROSS-REFERENCE TO RELATED APPLICATIONS

This application is a continuation of U.S. patent application Ser. No. 14/057,781 filed Oct. 18, 2013, which is a continuation of U.S. patent application Ser. No. 13/277,778 filed Oct. 20, 2011, (now U.S. Pat. No. 8,585,136 B2),which is a continuation of U.S. patent application Ser. No. 11/877,478 filed Oct. 23, 2007, which claims priority of U.S. Provisional Patent Application Ser. No. 60/853,669, filed Oct. 23, 2006.

STATEMENT REGARDING FEDERALLY SPONSORED RESEARCH OR DEVELOPMENT

Not applicable.

REFERENCE TO MICROFISHE APPENDIX

Not applicable.

BACKGROUND OF THE INVENTION

Field of the Invention

The invention relates to seating unites and more specifically, to multi-functional or reconfigurable chairs and the like. Known multi-functional or multi-tasking seating tends toward two general groups, namely, relatively complicated arrangements and relatively less complicated arrangements.

The more complicated designs typically attempt to address many common functional needs; all things to all users. Therefore, they tend to sacrifice a characteristic of being "user friendly" and require notable user involvement. The user may be required to accommodate a variety of components, which may be bulky. The multi-functional seating may also require an uncommon level of mechanical aptitude to adapt the seating between functional configurations.

Alternatively, the less complicated designs tend to be targeted to fairly narrowly defined functions. Thus, they are novelty or specialty seating units that are undesirable to any user who does not have a need for the particular function to which the seating was designed.

Thus, a need for easily used and versatile seating that fills a reasonable combination of common lifestyle uses may be readily understood.

BRIEF SUMMARY OF THE INVENTION

Accordingly, a chair with a coupling companion stool base of the invention is directed to the contemporary lifestyle needs of active users, including a range of functions from task seating at a work surface to casual relaxation. While suitable in any environment, a multi-tasking seating unit of the invention is particularly appreciated in smaller room settings, where space may be at a premium, where dedicated use furnishing may be considered undesirable, or where flexibility is appreciated.

The chair portion has a frame that may be supported above a generally horizontal surface by the base, which base releasably couples with the frame. More specifically, the frame has a lower portion that may support a sitting portion, which sitting portion is adapted to support a user who is seated upon the chair, and has an upper portion that may support a back rest, which back rest is adapted to support at least a portion of a back of the user. The frame lower portion extends from the upper portion and may further include a first portion that is near the frame upper portion, a second portion that is spaced away from the first portion, a claw that extends generally downward from the second portion, a latch that extends generally downward from the first portion, and at least two frame legs that extend generally downward from the frame lower portion. The frame legs are adapted to support the frame upon a generally horizontal supporting surface. In other aspects of the invention, the latch is connected with the frame first portion and moves between closed and opened positions.

The base has a saddle and extends generally upward from the supporting surface to the saddle. The saddle may be configured with opposite back and front edges. The saddle front edge may be configured to cooperate with the frame lower portion claw, so that the front edge may be releasably captured in the claw, while the saddle back edge may be configured to cooperate with the frame lower portion latch whereby the back edge may be releasably captured by the latch. When the frame is decoupled from the base, the frame forming the chair portion is adapted for use as casual floor rocker seating, and the base is adapted to provide a companion stool upon which a user may sit or, alternatively, a side table which may be positioned adjacent to the chair portion.

The saddle can further include a top surface that faces away from the supporting surface, as it defines at least one of a work surface, a writing surface and a sitting surface. The frame can also include a receptacle defined between the claw and the latch. The saddle of the base includes a perimeter edge incorporating the back and front edges, and circumscribing the top surface. The edge defines the top surface with a rotationally asymmetric geometry. The frame lower portion receptacle and the saddle perimeter edge correspond with one another so that the base couples with the frame only in one specific rotational orientation.

The chair can further include a bias member, which biases the latch to the closed position. The frame can include opposite left and right sides, with a first one of the two frame legs extending generally arcuately downward from the frame lower portion left side and second portion, and to the frame lower portion left side and first portion. A second one of the two frame legs extends generally arcuately downward from the frame lower portion right side and second portion, and to the frame lower portion right side and first portion. The frame legs define rockers. Further, the rockers can define protective rails about the latch. In addition, the latch can be located between the two frame legs, so that the legs define protective rails about the latch.

With the frame having opposite left and right sides, the claw can include a claw notch, a first tooth extending toward the left side from the notch, and a second tooth extending toward the right side from the notch. The saddle front edge can include a pair of cooperating claw notches. With the asymmetric configuration, the first tooth and the second tooth can be engaged with the saddle only through an engagement of the first tooth with a first one of the cooperating claw notches, and the second tooth with a second one of the cooperating claw notches. Further, the claw notch can be centered along the claw. With the frame decoupled from the base, the saddle top surface can be adapted to be oriented in front of the frame, with a first base leg of the plurality of base legs initially positionable under the claw, so that with the claw straddling the first base leg, the first base leg is adapted to nest into the claw notch.

The base can further include a pedestal extending generally upwardly from the supporting surface to the saddle. The pedestal can include a connector that operably connects the saddle with the pedestal, with the connector including at least one of a tilt mechanism, whereby the saddle tilts relative to the pedestal, and a swivel mechanism whereby the saddle swivels relative to the pedestal.

In accordance with a further aspect of the invention, the relative cooperation between the spaced apart teeth and the cooperating claw notches, and the sizing and configuration thereof, causes forces to be generated along the engagement points of the spaced apart teeth and the cooperating claw notches which tend to resist disengagement of the spaced apart teeth from the cooperating claw notches. This occurs when a user of the chair may exert backwardly directed or other leaning forces on the chair frame. Further, the base can include a set of triangular shaped ribs extending downwardly behind the back edge of the saddle. The positioning and configuration of the ribs behind the saddle back edge tend to generate forces resistive to accidental engagement of the chair to the frame, which may otherwise result in the latch not fully engaging with the cooperating latch notch, or from horizontal forces being exerted on the frame relative to the base which could tend to accidentally disengage the notch. Still further, a latch ramping surface can be positioned at the saddle back edge.

In addition to the foregoing, the chair includes means for insuring that a sound audible to a chair user is generated when the latch is moved from a disengaged position to a completely engaged position with the saddle back edge. In this manner, the user is provided with positive feedback that correct engagement of the latch with the saddle back edge has been achieved. These and other features, objects, and benefits of the invention will be recognized by one having ordinary skill in the art and by those who practice the invention, from this disclosure, including the specification, the claims, and the drawing figures.

DETAILED DESCRIPTION

Figure 1:
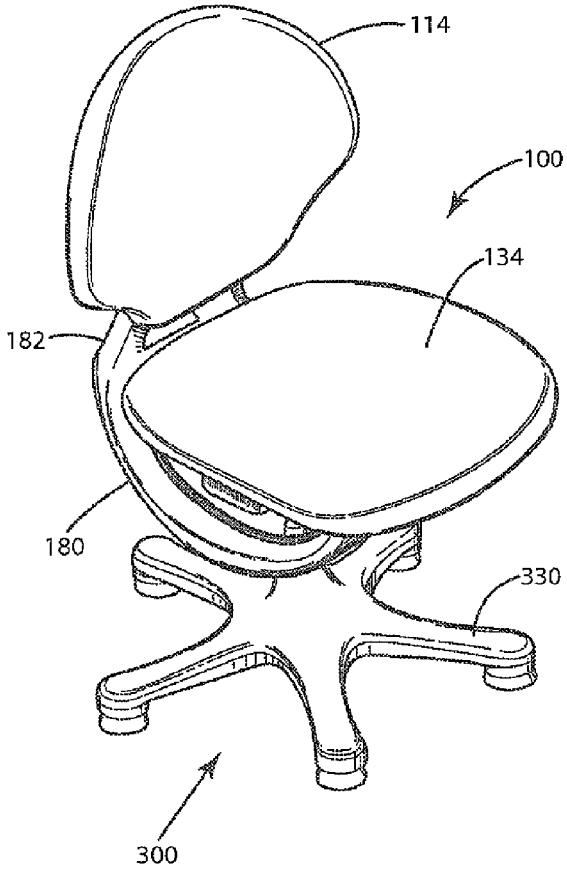
FIG. 1 is an upper front right perspective view of a chair with a coupling companion stool base of the invention, showing the chair portion and the companion stool base portion coupled in a task chair configuration.

A preferred embodiment of a chair with a coupling companion stool base according to the invention is generally shown in the drawing comprising FIGS. 1-23, and discussed below. The exemplary embodiment shown comprises two main portions, namely, a chair portion 100 and a base portion 300. (See e.g., FIGS. 1, 2).

Figure 18:
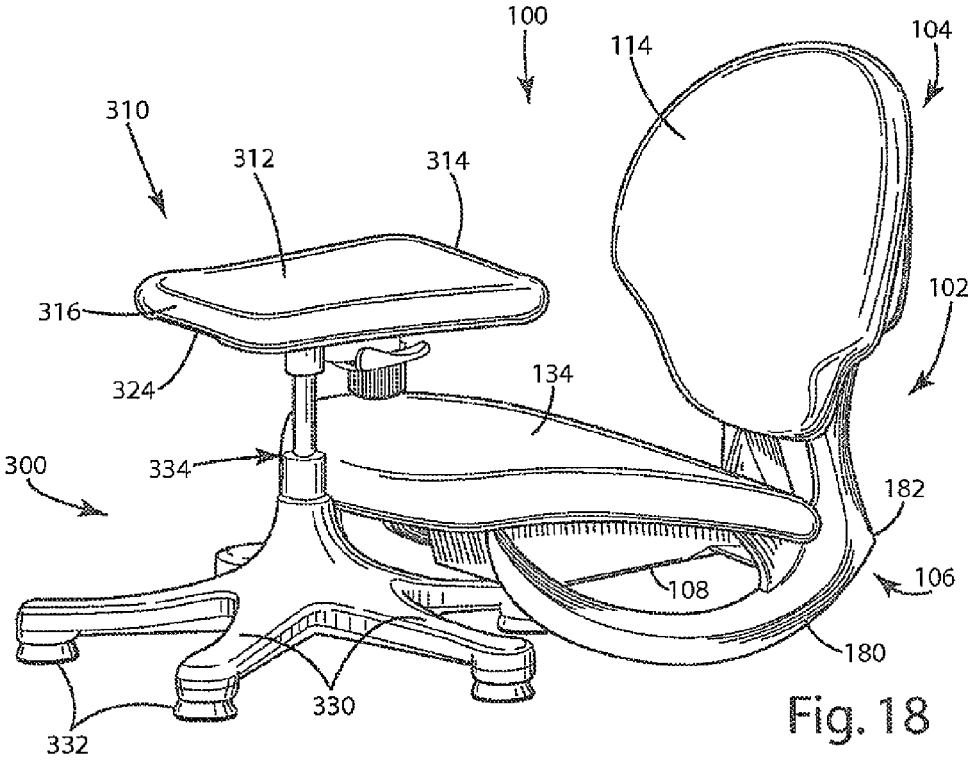
FIG. 18 is an upper right back perspective view of the uncoupled companion stool base portion together with an upper left front perspective view of the uncoupled chair portion, showing the two portions nested and the companion stool base portion providing a table function.

The chair portion 100 may be formed with a frame 102, which has an upper portion 104 and a lower portion 106 (FIG. 18). The frame 102 and the various components of the chair portion 100, unless otherwise noted, may be constructed of any suitable material, including structural materials that incorporate at least one of a plastic, a wood, a metal, and a ceramic, and of any method or process that may be appropriate to the material selected as may be known to one having ordinary skill in the chair fabrication art.

The upper portion 104 provides a back rest to support at least a portion of a back of a user. The upper portion may be configured as is known in what may be called "hard surface" chairs or seating, to be sufficiently comfortable or otherwise accommodating on its own. Otherwise, a padded or otherwise plush covering may preferably be provided as is shown. The upper portion 104 with the back rest is particularly shown in the exploded view of FIG. 17. With reference thereto, an upholstered back rest may include a foundation 112 and an upholstered covering 114 that may slip fit over the foundation, as shown and without limitation on the concept of the invention. The covered foundation 112 may then be secured to the upper portion 104 through various methods, including decorative hardware 116 (also shown in FIG. 17), such as screws as shown.

Figure 13:
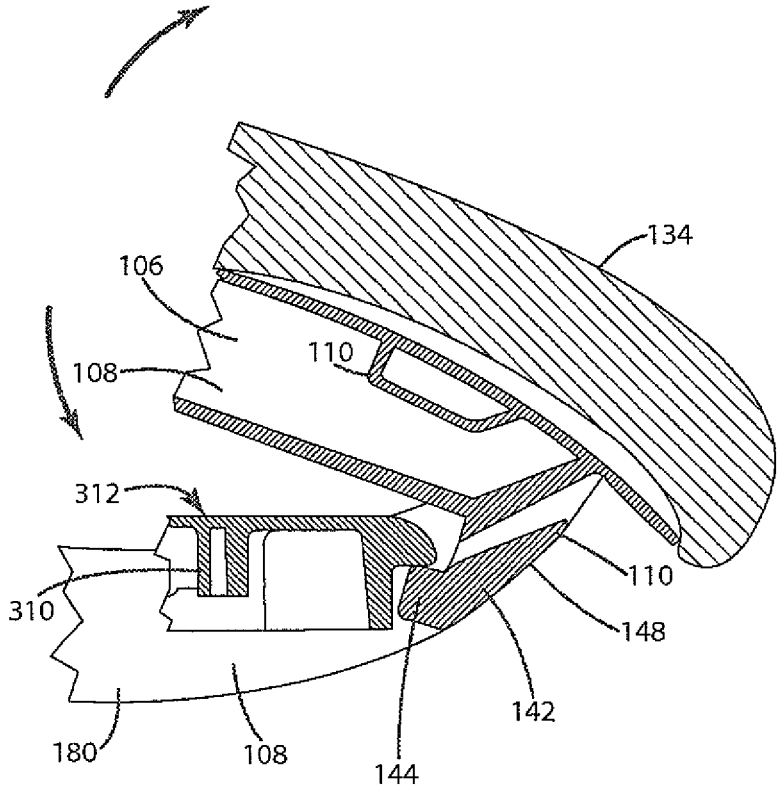
FIG. 13 is an enlarged view of detail XIII of FIG. 11.
Figure 14:
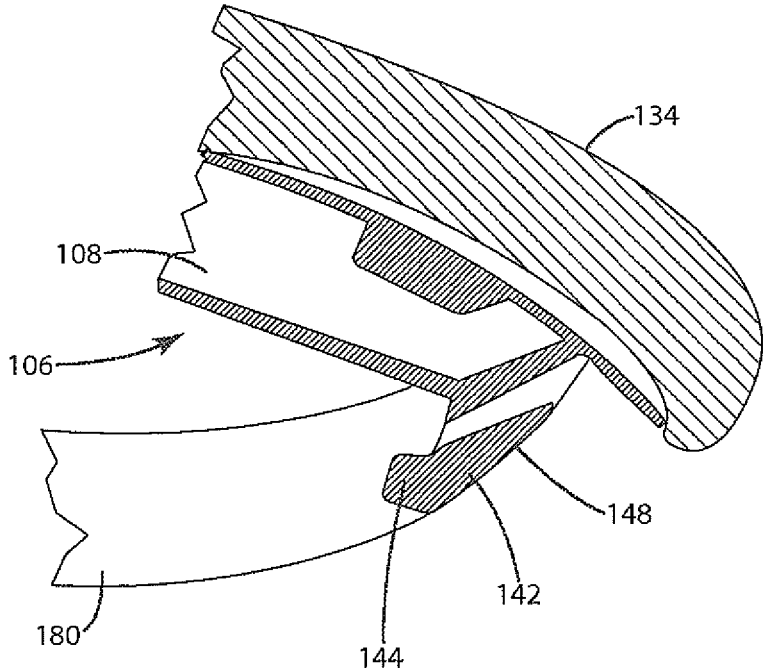
FIG. 14 is the detail view of FIG. 13 with the base portion removed.
Figure 15:
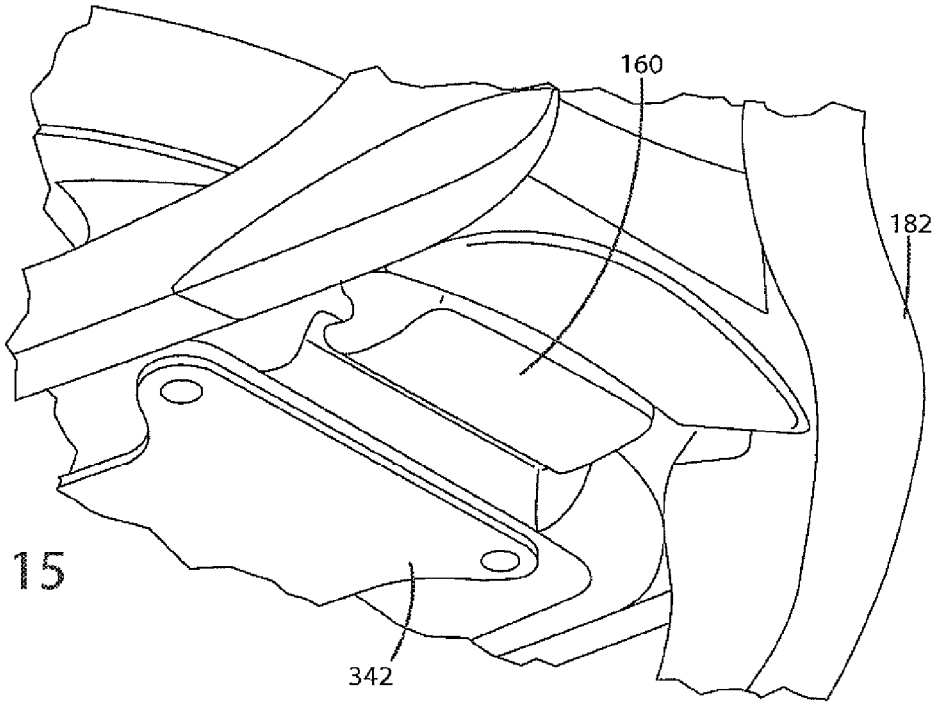
FIG. 15 is an enlarged detail view of the positive clip clamp latch of FIG. 8.

The frame lower portion 106 extends away and primarily forward from the frame upper portion 104. As further shown, for example, in FIG. 12 and the exploded view of FIG. 17, the frame lower portion 106 has a frame lower portion first portion 122 near the frame upper portion 104, and a frame lower portion second portion 124 that is spaced away from the first portion. In the example of this disclosure, the lower portion 106 is fabricated with opposite left and right side rails 108 and 118, respectively. One or both of the side rails 108 and 118 may be seen in a number of the drawings, including FIGS. 4, 5, and 17. A number of cross ties 110 of various cross section, including some with a generally V-channel, extend between the side rails 108, 110. The cross tics 110 are illustrated in FIGS. 9, 11-13 and 17. Other features of the frame lower portion 106 include a sitting portion which will be described in greater detail in subsequent paragraphs herein. In addition, the frame lower portion 106 includes a claw 142 extending generally downwardly. The claw 142 is illustrated in FIGS. 9, 10, 13 and 14. Still further, the frame lower portion 106 includes a clip clamp latch 160 which is shown in FIG. 15 and, in particular detail, in FIGS. 16 and 17. In addition to the clip clamp latch 160, the frame lower portion 106 also includes at least two frame legs 180 (see FIGS. 18 and 19 among others) and a receptacle 190 (FIG. 6).

Figure 17:
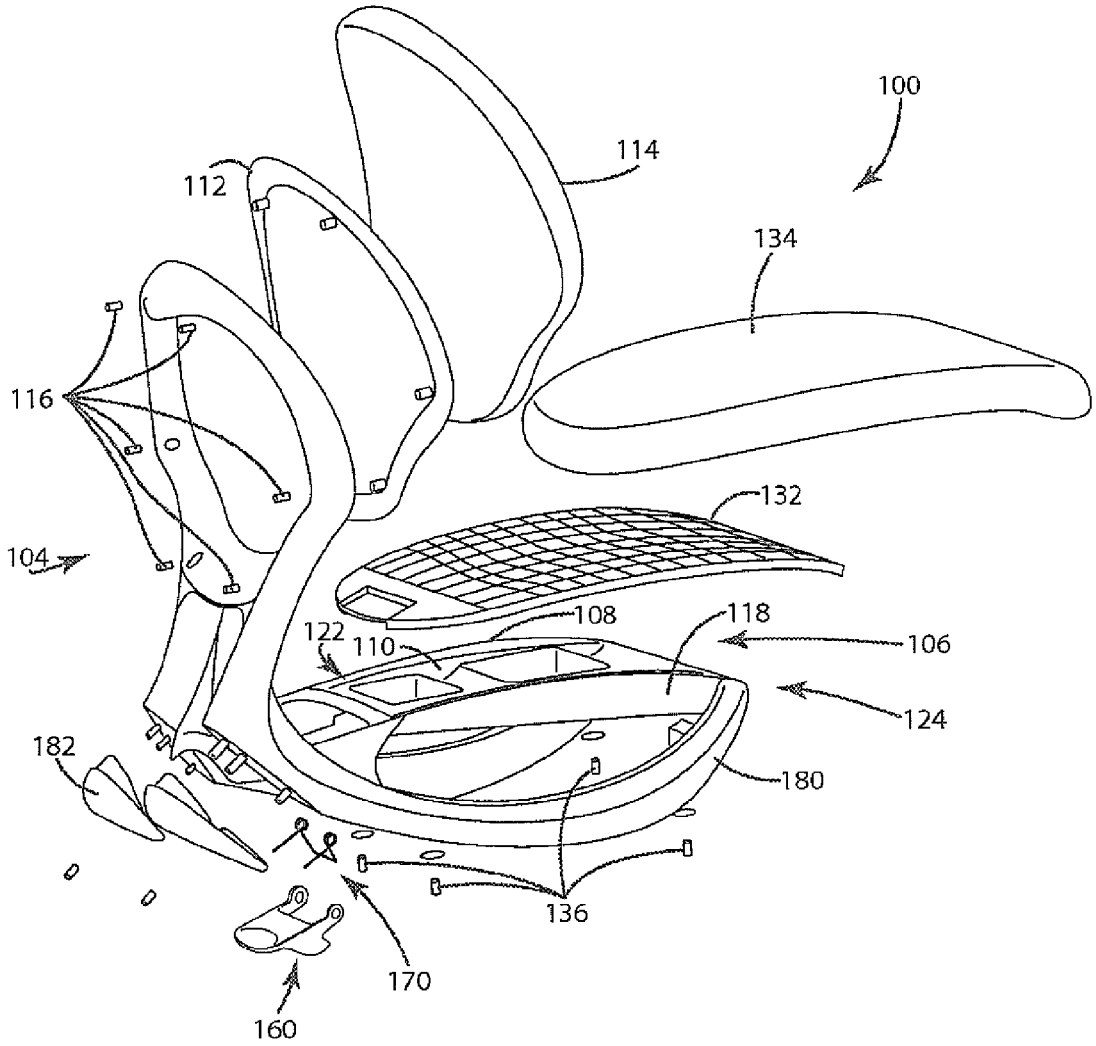
FIG. 17 is an exploded view of the chair portion, from an upper right back perspective view, showing a frame and upholstery foundations and coverings thereof.

The sitting portion supports the user who is seated thereupon. Quite similar to the back rest portion of the upper portion 104, discussed above, the sitting portion may be configured as is known in "hard surface" chairs, to be sufficiently comfortable or accommodating on its own. Alternatively, an upholstered sitting portion may preferably be provided, and may include a foundation 132 (particularly shown in the exploded view of FIG. 17) and an upholstered covering 134 that may slip fit over the foundation. The upholstered covering 134 is shown in several of the illustrations, including FIGS. 9-14 and 17. The covered foundation 132 may then be secured to the frame lower portion 106 through various methods as discussed above relative to the back rest, including decorative hardware 136, such as screws as shown in FIG. 17.

The claw 142 (illustrated in FIGS. 9, 10, 13 and 14) extends generally downward from the frame lower portion 106, near the second portion 124 of the frame lower portion 106, and is adapted for cooperating releasable engagement with the base 300. More specifically, and as will be discussed in greater detail in subsequent paragraphs herein, the claw 142 will function so as to releasably engage with a saddle 310 of the base 300. The saddle 310 is illustrated in many of the figures, including FIGS. 4, 5, 9-13 and 18-23. With reference again to the claw 142, it may be configured with a flange-like member 144 that extends toward the first portion 122. Of course, this is a specific configuration of an exemplary preferred embodiment, and one having ordinary skill in the art understands from this disclosure that a broad variety of adaptations of the claw and saddle interaction element of the invention may be made within the concept of the invention. The claw 142 may be considered to define an at least somewhat arcuate member, including smoothly arcuate and broken angular configurations. The claw 142 as shown also extends laterally between the left and the right rails, 108 and 118 respectively. The claw 142 is, thereby, cleverly incorporated in the structure of lower portion as a cross tie 110, in the example shown.

Figure 2:
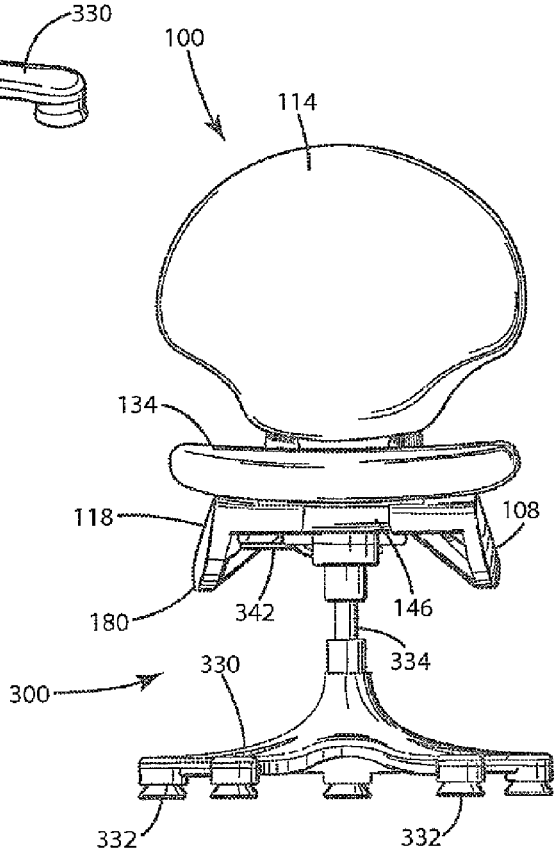
FIG. 2 is a front elevation view thereof.
Figure 3:
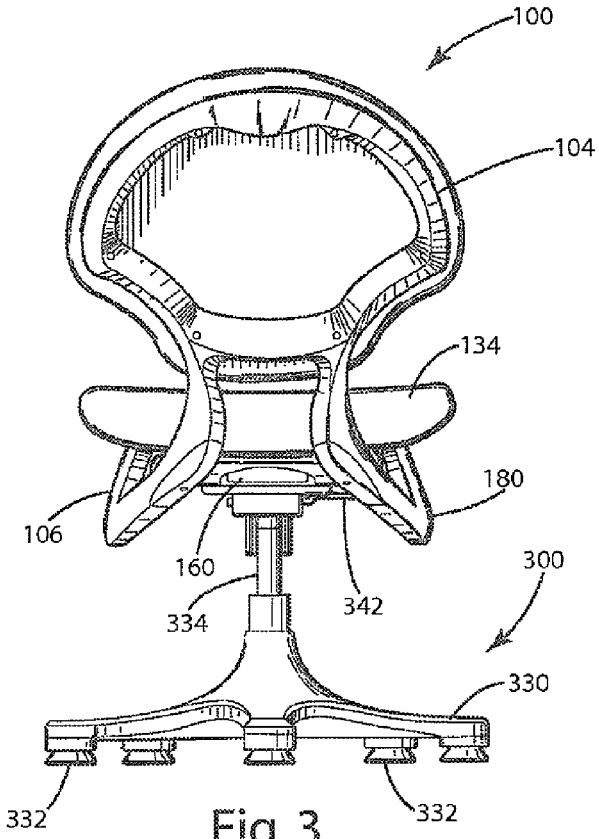
FIG. 3 is a back elevation view thereof.
Figure 4:
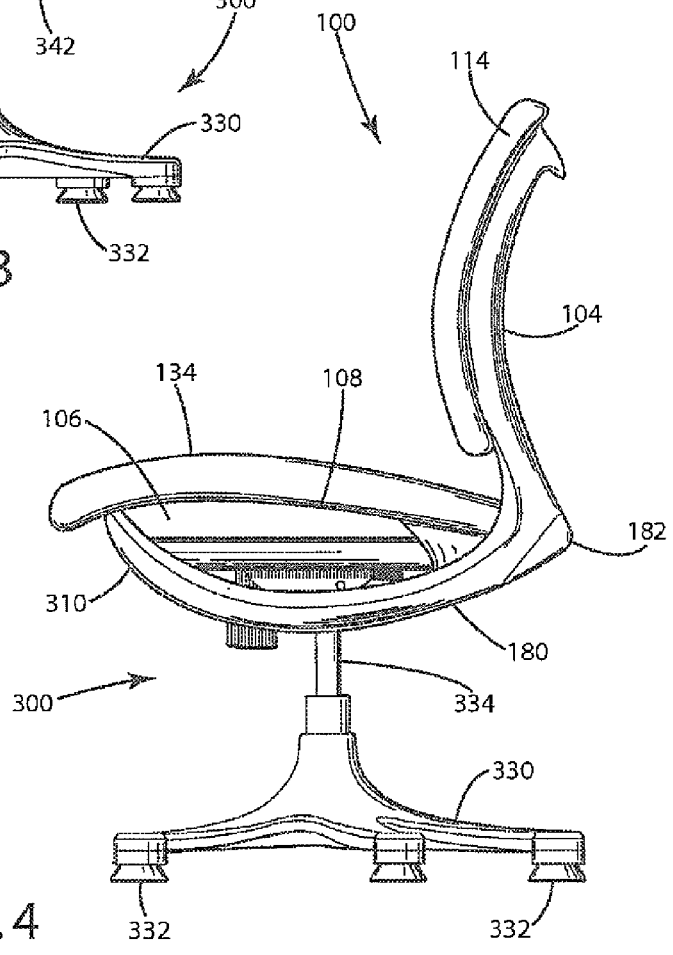
FIG. 4 is a left side elevation view thereof.
Figure 5:
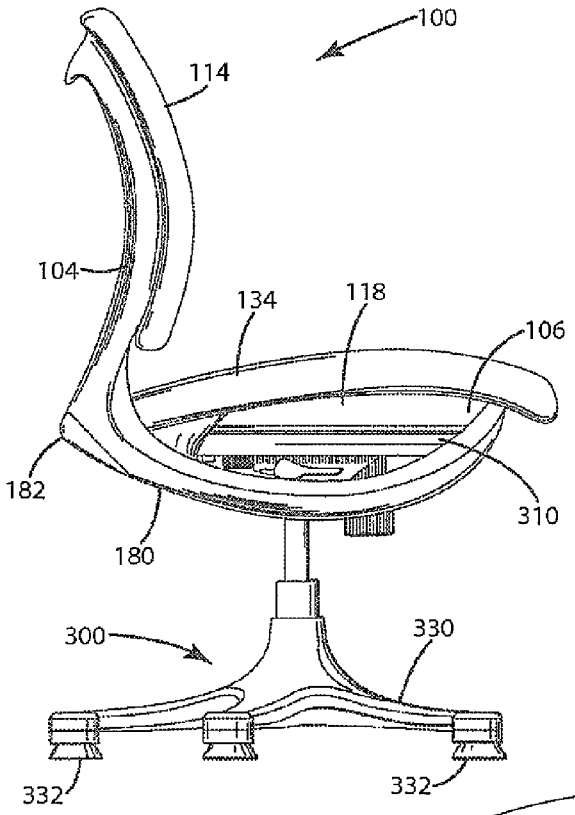
FIG. 5 is a right side elevation view thereof.
Figure 6:
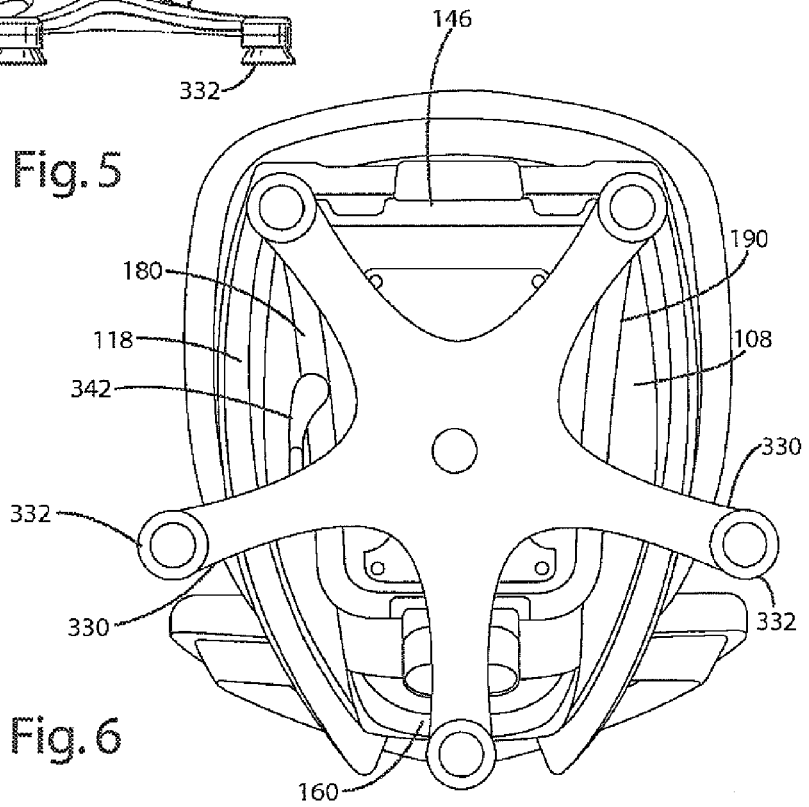
FIG. 6 is a bottom plan view thereof.
Figure 7:
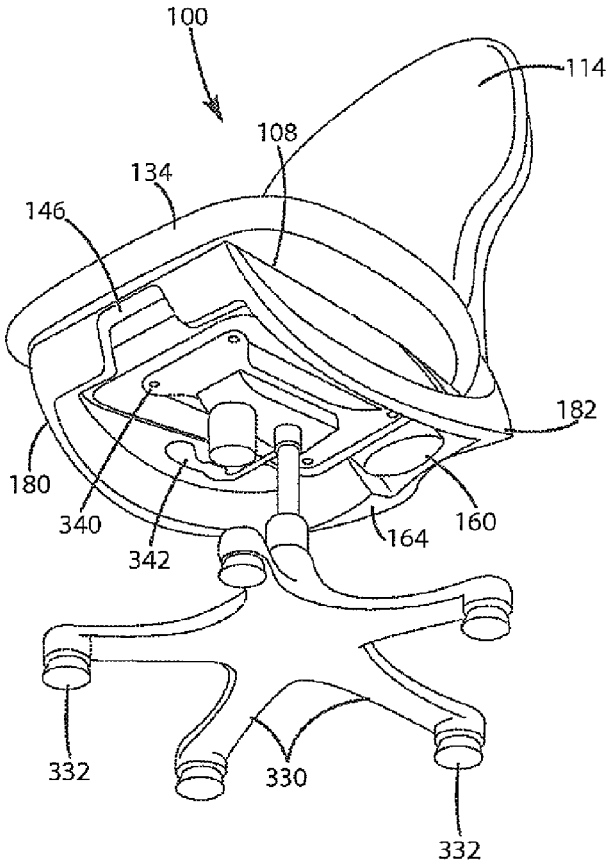
FIG. 7 is a lower left front perspective view thereof.
Figure 8:
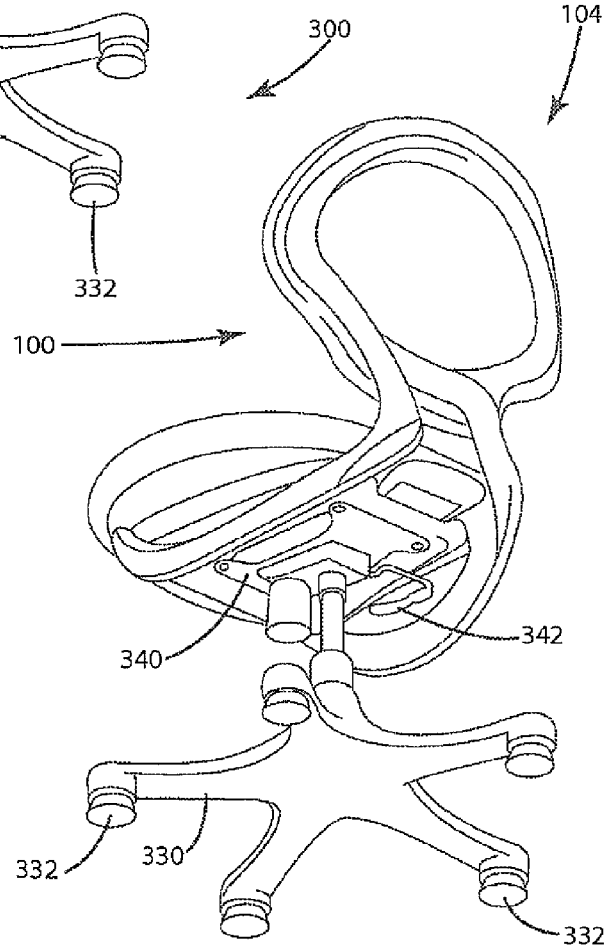
FIG. 8 is a lower back left perspective view thereof.
Figure 9:
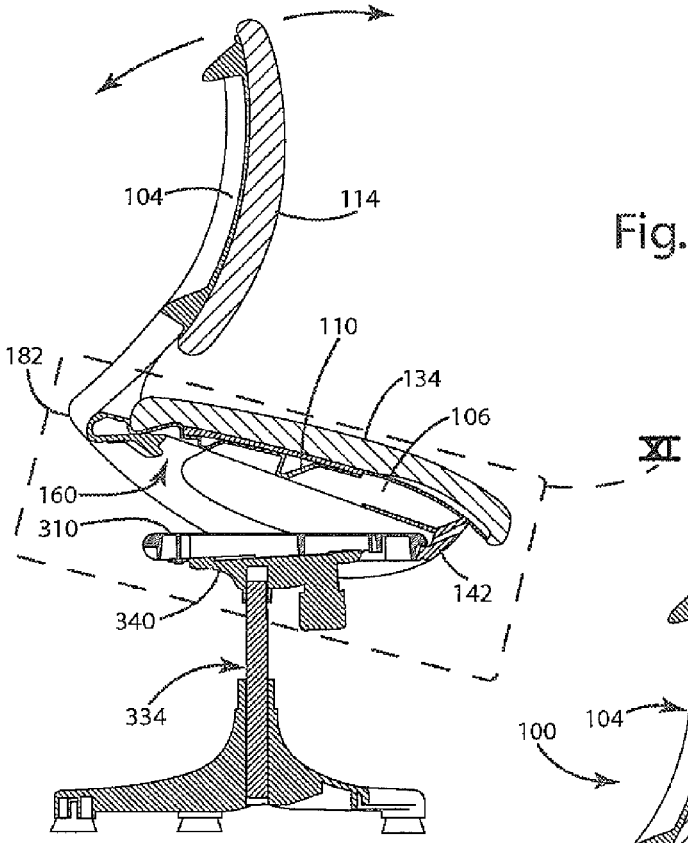
FIG. 9 is a fragmentary right side elevation view thereof, showing coupling/uncoupling of the chair portion and the coupling companion stool base portion, with the chair portion partially in cross section.
Figure 10:
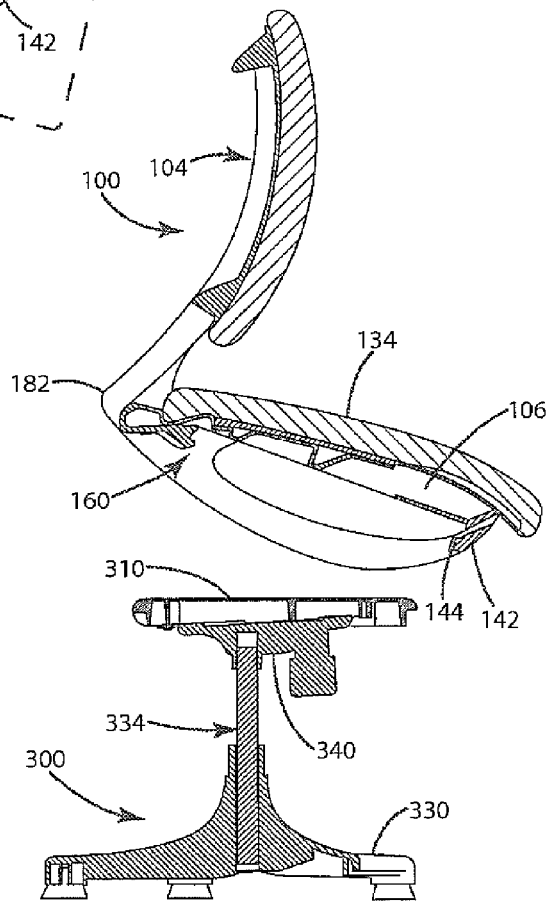
FIG. 10 is the view of FIG. 9, showing the chair portion and the coupling companion stool base portion uncoupled.
Figure 11:
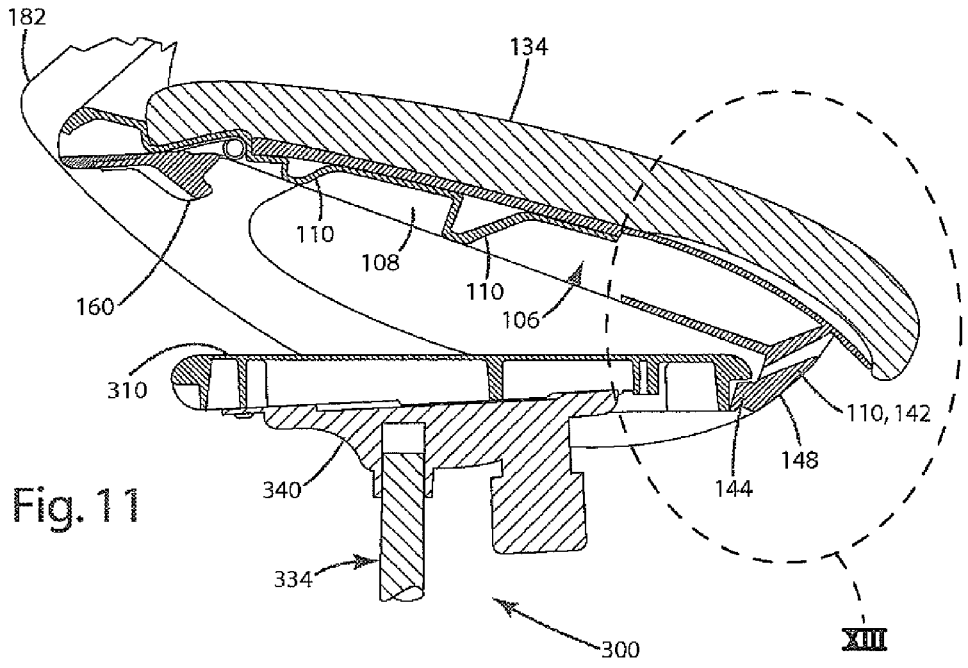
FIG. 11 is an enlarged view of detail XI of FIG. 9.
Figure 12:
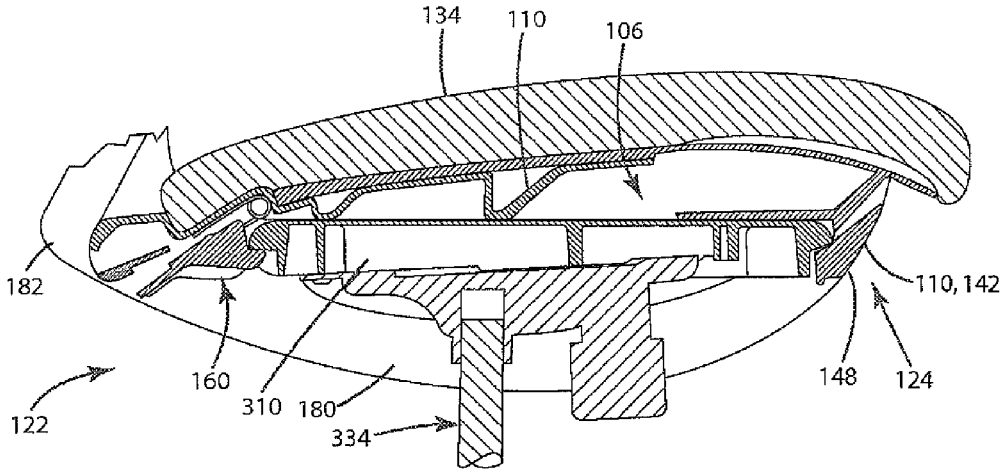
FIG. 12 is the view of FIG. 11, with the chair and the base portions coupled.

In another aspect of the claw 142, a notch 146 may be provided for nesting accommodation with a leg of the base 300, discussed further below (FIGS. 2, 6 and 7). Thus, the notch 146 may preferably be generally centered along the claw 142, between the rail 108 and 118. So defined, the notched claw 142 may be said to include a first tooth 148 that extends toward the left side from the notch, and a second tooth 148 (with the teeth being shown in FIGS. 9, 10, 11, 13 and 14) that extends toward the right side from the notch. It is further noted that the claw 142 as shown incorporates user safety considerations at least insofar as the cooperating geometry of the claw 142 with the saddle 310 tends to engage the chair portion 100 with the base portion 300, so the chair portion 100 will not tilt or rotate backward apart from the base.

The clip clamp latch 160 is illustrated in a number of the drawings, including FIGS. 3, 6, 8, 9-12 and 15-17. In particular, the latch 160 is shown in a "stand alone" view in FIG. 16. More specifically, the clip clamp latch 160 extends generally downward from the frame lower portion 106, near its first portion 122, and is adapted for cooperating releasable engagement with the base 300 and more specifically with the saddle 310 of the base, discussed further below. While the claw 142 is shown as a fixed member, at least one of the claw 142 and the latch 160 is preferably a movable member so that the chair portion 100 and the base 300 are releasably coupled. Thus, the latch 160 may, for example, be hingedly connected with the first portion of 122. However, it should be emphasized that other types of connections may be utilized, without departing from the principal concepts of the invention. As shown particularly in FIG. 16, the latch 160 may be considered as presented with a general configuration of a length of a stylized L-channel or V-channel, having a first leg 162 and a second leg 164, each extending outward from an apex 166.

Figure 16:
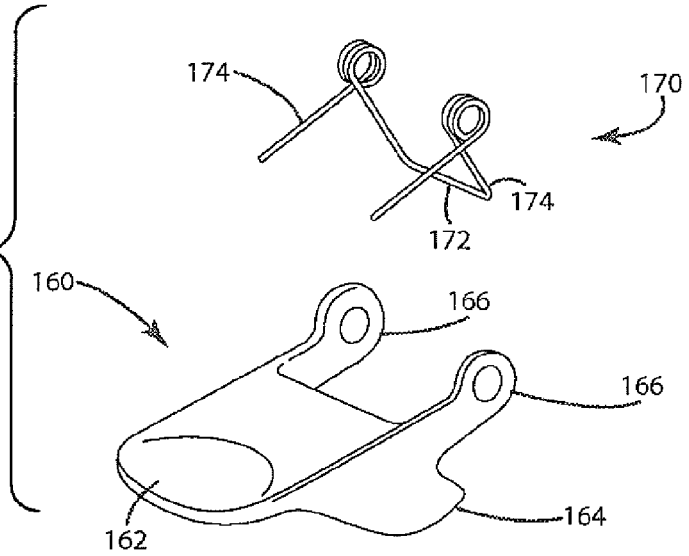
FIG. 16 is an exploded view thereof, from an upper right back perspective view.

The apex 166 defines a hinge or pivot point of the latch 160, so the latch 160 hinges between closed and opened positions. In the closed position, the latch 160 extends relatively closer to the frame lower portion second portion 124. Conversely, the latch extends relatively farther from the second portion 124 in the opened position. Further, a bias member 170 preferably biases the latch to the closed position (FIGS. 16 and 17). As particularly shown in FIG. 16, the bias member 170 is shown as a generally U-shaped spring member with a bight portion 172 and a leg 174 extending in the same general direction from each end of the bight portion 172. Each leg 174 may also incorporate a helical coil spring that aligns with the pivot point 166 of the latch 160. When assembled as shown, the bias member legs 174 press against the latch first leg 162 and rotate the latch 160 generally forward toward the second portion 124.

The latch first leg 162 defines a handle or actuator with which a user may actuate or open the latch, rotating the latch about the latch pivot 166 and generally away from the frame lower portion second portion 124, to release the chair and the base portions. The latch second leg 164 defines a clamping portion of the latch that engages and clasps the saddle 310 as discussed further below. As with the claw 142, the latch 160 shown is another specific configuration of an exemplary preferred embodiment and one having ordinary skill in the art understands from this disclosure that a broad variety of adaptations of the claw and saddle interaction element of the invention may be made within the concepts of the invention.

Figure 19:
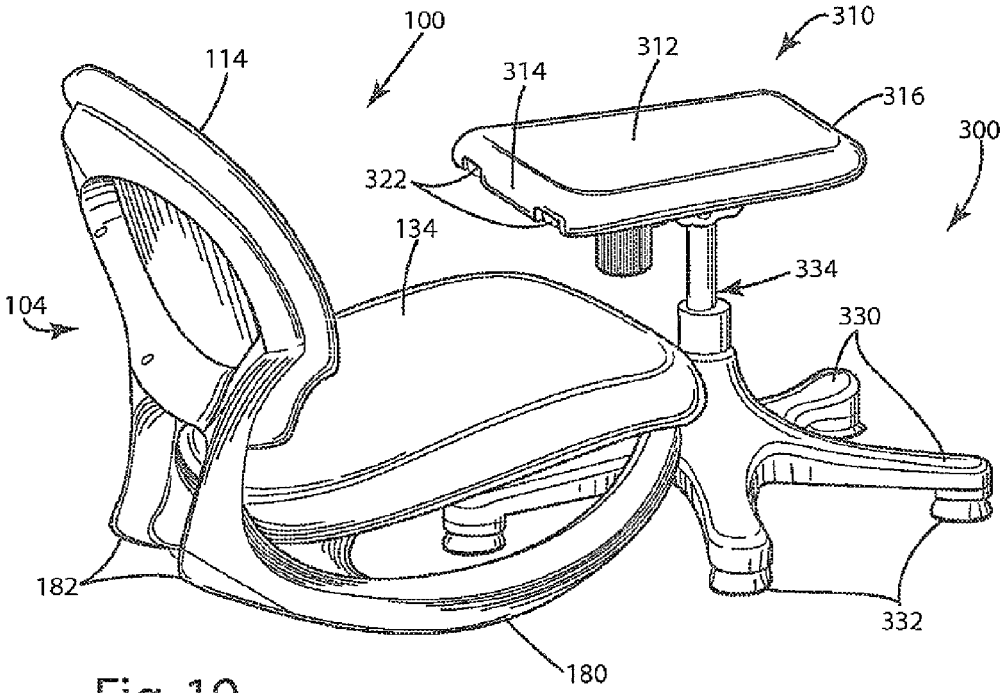
FIG. 19 is an upper left front perspective view of the uncoupled companion stool base portion together with an upper right back perspective view of the uncoupled chair portion.

As shown in several views, and as particularly apparent from FIGS. 17, 18 and 19, the legs 180 of the chair portion 100 extend generally downward from the frame lower portion 106 and are adapted to support the frame upon a generally horizontal supporting surface. The legs 180 may have various configurations. Given an inherent relatively shortened geometry of the chair portion 100 when uncoupled from the companion stool base portion 300 and set upon the supporting surface, it is anticipated that a user who is seated in the chair will naturally and commonly tend to tilt the chair portion generally backward. Thus, the legs 180 are desirably configured as rockers, defining the chair portion as a floor rocker. The legs 180 may be described as extending generally arcuately downward from the frame lower portion second portion 124 to the first portion 122, and along each of a left and a right side of the chair. Further, the legs 180 are preferably artfully incorporated into the chair frame 102 and extend to stops 182 at a very back of the frame lower portion 106, near where the upper portion 104 and the lower portion 106 meet (FIGS. 1, 4-7, 11, 12, 16, 18 and 19). The stops 182 may preferably be placed and contoured so as to provide a comfortable and positive stop to backward rocking of the chair, and so that the user may not unsafely rock the chair completely backward. Yet, a limit to backward rocking of the chair is most preferably not abrupt. It is also noted at this point that the latch 160 may be tucked-in or located between the legs 180, which extend beyond the latch 160, so that the legs 180 define protective rails about the latch 160.

The receptacle 190 corresponds with the saddle 310 and is defined between the claw 142 and the latch 160, which may be said to define end boundaries (FIG. 6). The frame lower portion left and right side rails 108 and 118, respectively, may also be said to define side boundaries. With the bounds so identified, the receptacle 190 may be seen to have a generally trapezoidal geometry. The corresponding geometry of the receptacle 190 and the saddle 310 may be selected for unitary keying alignment of the chair portion 100 with the base portion 300, among other considerations. Cooperating engagement of the receptacle 190 with the saddle 310, and thus releasable coupling of the chair and the base portions 100, 300, respectively, is discussed further below.

More specific details of the base portion 300 will now be described, particularly with respect to FIGS. 18-23. The base portion 300 releasably couples with the frame 102 and is adapted to support the frame 102, and thus the chair portion 100, above a generally horizontal supporting surface. One having ordinary skill in the art understands that a broad variety of adaptations of chair bases, including categories of legged, sled, and pedestal, are available to support a chair frame above the supporting surface. What may be commonly known as a five legged pedestal base is generally shown in the drawing figures of the exemplary preferred embodiment.

Figure 22:
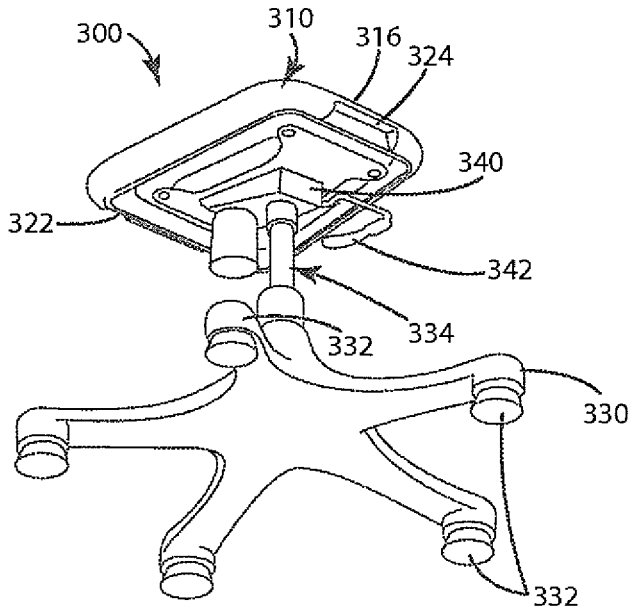
FIG. 22 is a lower left back perspective view thereof.
Figure 23:
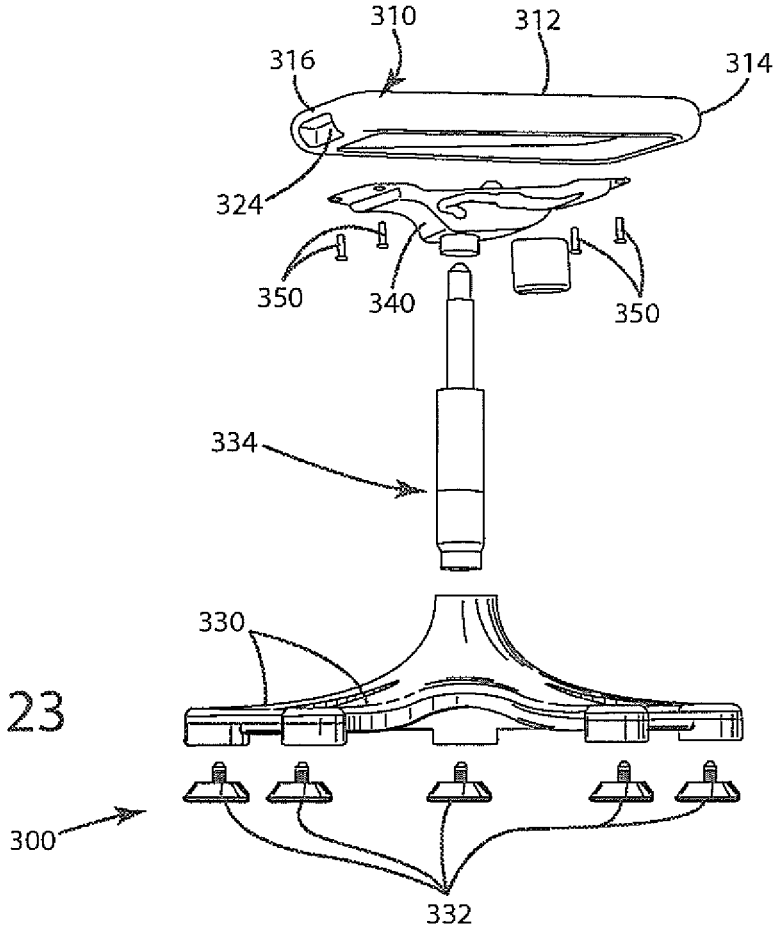
FIG. 23 is an exploded right back perspective view thereof.

The base 300 extends generally upward from the supporting surface to the saddle 310. The base stands upon the surface with a star foundation that has five legs 330 as shown generally throughout the drawing, although other numbers of legs is known. Each of the legs 330 extends radially out from a center vertical axis to a pad 332, although a caster, for example, may be used in the alternative. A post 334 extends along the vertical axis from the foundation to a chair control or position mechanism 340 (FIGS. 22, 23). The post 334 may be an extensible member, including a screw mechanism, a pneumatic mechanism, and the like. The chair control 340 may be adapted to provide tilt or swivel movements as is known. A height adjustment control with an actuator 342 may also be incorporated in the chair control 340. As shown generally in the drawing, the saddle 310 and the chair control 340 are adapted to mount the saddle 310 on top of the chair control 340 with screw fasteners 350 and the like, although this is not a limitation of the invention. Thus, the chair control 340 may be a connector that operatively connects the saddle 310 with the pedestal 334 and may provide at least one of a tilting movement of the saddle 310 relative to the pedestal 334 and a swivel movement of the saddle 310 relative to the pedestal. Further, coupling of the chair portion 100 with the saddle 310 may also provide tilt or swivel movements of the chair portion 100.

The saddle 310 is shown configured as a generally planar member and may invoke a very general concept of a thick board. The saddle 310 is not just any board, however. More specifically, the saddle 310 has a top surface 312 that faces away from the supporting surface (FIGS. 18-21). A perimeter edge circumscribes the top surface 312 and includes opposite front and back edges 314 and 316, respectively, of the saddle 310 (FIGS. 18-23). The front edge 314 cooperates with the frame lower portion claw 142 whereby the front edge is releasably captured in the claw. The back edge 316 cooperates with the frame lower portion latch 160 whereby the back edge is releasably captured by the latch. The front and the back edges 314, 316 are also instrumental in defining the top surface 312 with a rotationally asymmetric geometry in the exemplary embodiment shown. A rotationally asymmetric geometry is significant to provide a keyed coupling of the chair portion 100 with the base portion 300, and most preferably a unitary keyed coupling with one alignment.

The saddle 310 has a generally trapezoidal geometry that cooperates with the receptacle 190 (the receptacle 190 being shown in FIG. 6). As contrasted with a square peg that may couple in one of four orientations with a corresponding square hole, a triangular peg having an equilateral cross section that may couple in one of three orientations with a corresponding triangular hole, or a rectangular peg coupling in one of two orientations with its corresponding rectangular hole, a trapezoidal peg couples in one orientation with a corresponding trapezoidal hole. Thus the saddle 310 is shown with a generally trapezoidal plan view for a rotationally asymmetric geometry to key the chair portion 100 and the base portion 300 in one relative orientation. Of course, geometries other than trapezoidal may be chosen by one who uses the invention. The inventor has found the trapezoidal geometry to be most convenient in use, however.

Figure 20:
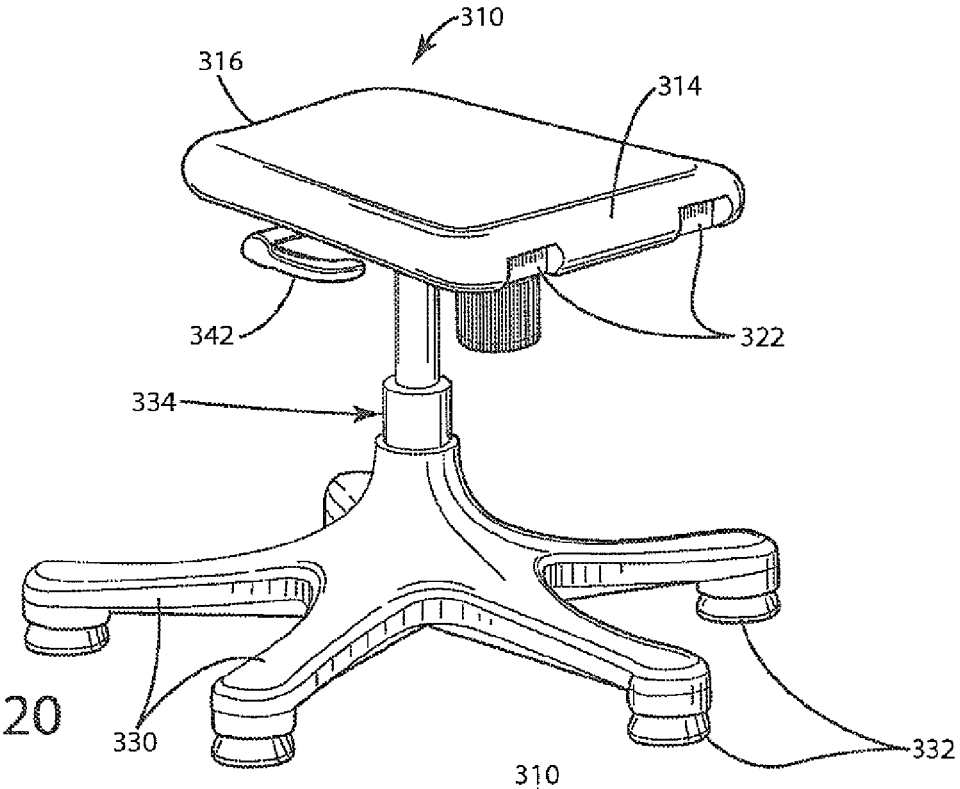
FIG. 20 is an upper front right perspective view of the uncoupled companion stool base portion thereof.
Figure 21:
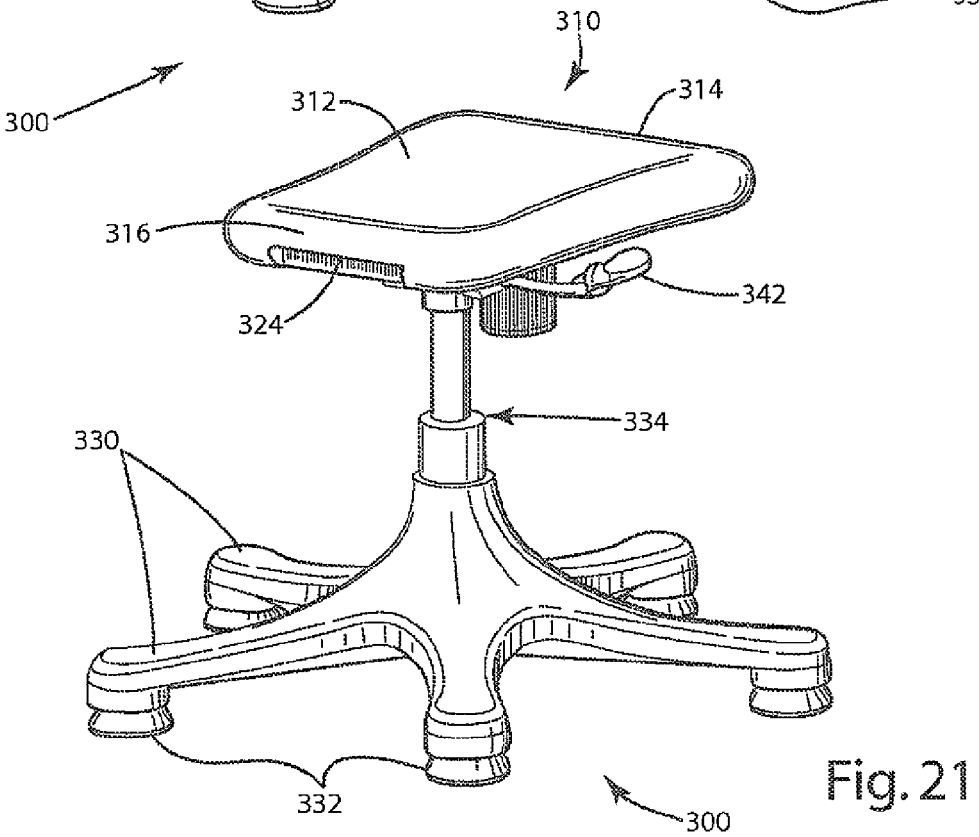
FIG. 21 is an upper back right perspective view thereof.

In use, the chair portion 100 and the base portion 300 may be separate, with the chair portion 100 providing casual floor rocker seating (FIGS. 18 and 19). The base portion 300 may be engaged by the user or another user in several functions, including a companion stool upon which a user may sit and a side table. Therefore, the saddle top surface 312 may define at least one of a work surface, a writing surface, and a sitting surface. The base portion 300 may commonly be oriented in front of the chair when employed as a writing surface or other work surface (FIGS. 19 and 20). For closest proximity of the top surface 312, a user who is seated in the chair may orient the star foundation with one of its legs 330 extending toward the chair 100. So oriented, the selected one of the legs may extend under the claw 142. By providing the notch 146, the chair may rock forward over the leg with the claw straddling the leg, which leg nests into the notch 140 between the teeth 148. More specifically, with the claw 142 including the claw notch 146 generally centered along the claw 142 and with the frame 102 decoupled from the base portion 300, the saddle top surface 312 is adapted to be oriented in front of the frame 102. With this orientation, a first one of the base legs 330 is initially positionable under the claw 142, so that with the claw 142 straddling the first one of the base legs 330, the first one of the base legs 330 is adapted to nest into the claw notch 142.

Alternatively, the chair portion 100 may releasably couple with the base portion 300 and provide a task chair or desk chair for a user (FIGS. 1-8). Coupling of the chair with the base is easily accomplished by manipulating the chair so the saddle front edge 314 slides toward and into the claw 142, which is of course from a perspective of the chair portion. In actual practice, the base 300 will typically be stationary while the chair moves under manipulation.

The rotationally asymmetric geometry of the base saddle 310 and the frame lower portion receptacle 190 may be best appreciated at this point at least insofar as such a geometry requires one functional alignment and engagement of the chair and the base portions. The receptacle 190 and the saddle 310 correspond with one another so that the saddle couples with the receptacle 190 in one rotational orientation, namely, with the saddle front edge 314 releasably captured in the claw 142 and the saddle back edge 316 releasably captured by the latch 160. As stated in another manner, and as previously described herein, the frame 102 includes the receptacle 190 defined between the claw 142 and the notch 146. The saddle 310 of the base portion 300 includes the perimeter edge incorporating the front and back edges 314, 316, respectively. The perimeter edge circumscribes the top surface 312 and defines the top surface 312 with a rotationally asymmetric geometry. With this geometry, the frame lower portion receptacle 190 and the saddle perimeter edge correspond with one another, so that the base portion 300 couples with the frame 102 only in one specific rotational orientation.

The chair portion 100 may then be rocked or pivoted generally backward to engage the latch 160 with the saddle back edge 314. As the chair rotates backward, the latch second leg 164 may strike or otherwise engage the saddle back edge and ramp open. Thus, a latch ramping surface may preferably be provided at the saddle back edge. Alternatively, a user may manually manipulate the latch, with its first leg 162, to the open position. With the chair at rest in a position of being coupled with the base, the latch bias 170 holds the latch in the closed position.

For enhanced coupling of the saddle 310 in the receptacle 190, cooperating claw notches 322 may be formed in the saddle front edge 312 and a cooperating latch notch 324 may be formed in the saddle back edge 314. The claw notches 322 facilitate secure engagement of the claw 142 with the saddle front edge 314 and may be significant relative to resisting forces that may develop when a user leans or rocks backward. The latch notch 146 may help the latch 160 resist forces that may tend to open the latch. Further, triangular shaped ribs, or the like, also preferably extend downward, behind the saddle back edge, to further prevent horizontal forces from unintentionally opening the latch. It is also noted that the saddle 310 may support the cross-ties 110 in abutting engagement, when the chair portion 100 and base portion 300 are coupled, to enhance stability of the task chair configuration (FIGS. 13, 14). To further explain the foregoing concepts, and as generally described herein, the claw 142 can include a pair of spaced apart teeth extending along the left and right sides of the frame 102. A pair of cooperating claw notches 322 are formed in the saddle front edge 314, and the front edge 314 is releasably captured in the claw 142 through engagement of the teeth with the cooperating claw notches 322. This relative cooperation between the spaced apart teeth and the cooperating claw notches 322, and the sizing and configuration thereof, causes forces to be generated along the engagement point of the spaced apart teeth 148 and the cooperating claw notches 322 which tend to resist disengagement of the teeth 148 from the claw notches 322 when a user of the chair makes backwardly directed or other leaning forces on the chair frame 102. Still further, the positioning and the configuration of the triangular shaped ribs beyond the saddle back edge 316 will tend to generate forces resistant to accidental disengagement of the chair portion 100 from the frame 102 which may otherwise result from a latch not fully engaging with the cooperating latch notch, or from horizontal forces being exerted on the frame 102 relative to the base portion 300, which could tend to accidentally disengage the latch 160.

In addition to the foregoing, other concepts associated with a chair with coupling companion stool base in accordance with the invention may be generally stated. As earlier described, and as one of the advantages in accordance with certain aspects of the invention, the frame 102 forming the chair portion 100 is adapted for use as casual floor rocker seating. In combination with this rocker seating, the base portion 300 is adapted to provide a companion stool upon which a user may sit or, alternatively, a side table which may be positioned adjacent to the chair portion 100.

As also previously described, the base portion 300 includes a pedestal or post 334 which extends generally upward from the supporting surface to the saddle 310. This pedestal or post 334 includes a connector which operatively connects the saddle 310 with the pedestal or post 334. The connector, as previously described herein, can include a tilt mechanism so that the saddle 310 may be tilted relative to the post 334. Also, the connector can include a swivel mechanism, so that the saddle 310 swivels relative to the pedestal or post 334.

Still further, the concept of utilizing the clip clamp latch 160 for purposes of engaging the frame 102 to the back edge 316 of the saddle 310 has been described in substantial detail. However, another concept in accordance with the invention relates to a safety feature of providing audible "notice" to the user that correct engagement of the latch 160 with the back edge 316 has been achieved. More specifically, with the components of the latch 160 and the saddle 310 as described herein, the proper engagement will result in a "click" which will be of a sufficient volume and frequency so as to be audible to a user. This audible click can be achieved with the components as described herein, with the use of appropriate materials and with proper sizing and configuration thereof.

One having ordinary skill in the art and those who practice the invention will understand from this disclosure that various modifications and improvements may be made without departing from the spirit of the disclosed inventive concept. One will also understand that various relational terms, including left, right, front, back, top, and bottom, for example, are used in the detailed description of the invention and in the claims only to convey relative positioning of various elements of the claimed invention. The scope of protection afforded is to be determined by the claims and by the breadth of interpretation allowed by law.

The invention claimed is:

1. A multifunction task chair comprising:

a chair having a seat with a front and a rear; a backrest and a frame interconnecting the seat and backrest and providing a set of fore-and-aft extending rails under said seat;

a pedestal base having a single vertical support with a plurality of radially outwardly extending legs at the bottom end, and a saddle providing a generally flat tabletop at the top end, said saddle being at such height as to be accessible as a work surface to a user seated in said chair while said chair is separated from said base and resting on said rails, said saddle having a periphery with front, rear and side surfaces;

an attachment mechanism for securely but releasably attaching the frame on the underside of said seat to the saddle, said mechanism being operable to attach the chair and the base together only in a rotational orientation wherein the front edge surface of the saddle generally underlies the front of the seat;

said saddle being configured to underlie said seat between said rails when the chair is attached to the saddle.

2. The multifunction task chair defined in claim 1 wherein:

the rails define left and right mirror-image contoured members extending, at least in part, from the rear of the seat to the front of the seat and underlying the seat, said members being spaced apart enough to straddle said saddle there between and of such vertical depth as to engage the floor only when the chair is separated from said pedestal base.

3. The multifunction task chair defined in claim 1 wherein:

said rails bow outwardly and are provided with floor engaging surfaces that are configured to permit pitch angle changes for said chair when resting on said rails.

4. The multifunction task chair defined in claim 1 wherein:

the rails are generally spaced apart but converge toward the rear of the seat.

5. The multifunction task chair defined in claim 3 wherein:

the rails extend divergently from the rear of the seat upwardly along the back of the backrest and come together to form a closed figure.

6. The multifunction task chair defined in claim 1 wherein:

the vertical support is attached to the saddle at a point which is offset toward the rear edge.

7. The multifunction task chair defined in claim 1 wherein:

the saddle is configured to provide a visual identification of the front edge.

8. The multifunction task chair defined in claim 1 wherein:

the frame includes a receptacle beneath said seat generally shaped to receive said tabletop therein.

9. The multifunction task chair defined in claim 1 wherein:

the attachment mechanism includes a spring-biased latch located proximate the rear underside of the seat and a claw dependingly located adjacent the front of said seat for releasable engagement with the front edge surface of said saddle.

10. The multifunction chair defined in claim 9 wherein:

the periphery of the saddle is configured to force the latch open by contact when the chair is placed on the saddle for attachment purposes.

11. The multifunction task chair defined in claim 10 wherein:

the closing of the latch upon attaching the chair to the saddle produces an audible signal.

12. The multifunction task chair defined in claim 1 wherein:

the frame includes a cross rail and a receptacle for said saddle.

13. The multifunction task chair defined in claim 12 wherein:

the rails are made of plastic.

14. A chair with a companion base adapted to accommodate the lifestyle of active users including a range of functions from task seating at a work surface to casual relaxation comprising:

a chair portion having a seat, a backrest and a frame defining a set of longitudinally extending rails disposed under the seat and configured to allow said chair portion to assume multiple pitch angles when said rails are resting on a floor;

said frame further defining a downwardly opening receptacle immediately beneath said seat and between said rails;

a pedestal base portion having a single vertical support member, a set of radially outwardly extending legs fixed to the bottom end of said member and a saddle providing a tabletop fixed to the top end of said member, said saddle providing, where exposed, a generally flat work surface, having a visually defined front edge and peripheral side edge surfaces, said saddle being configured to fit into and become laterally constrained by said receptacle; and a latch mechanism for manually releasably attaching the chair to the saddle with the saddle in said receptacle and between said rails; said latch mechanism being operable to attach the chair to the base only in a rotational orientation wherein said front edge of the saddle is nearest the front of the seat.

15. The chair defined in claim 14 wherein the rails are rocker shaped.

16. A convertible article of furniture consisting of:

a chair portion comprising a seat, a back rest, and a frame at least partly underlying said seat and joining the seat to the back rest and providing a pair of fore and aft extending rail type legs for said chair portion and a downwardly opening receptacle disposed under the seat, said chair portion further comprising an attachment mechanism;

a pedestal base having a columnar support member with a top and a bottom end, the bottom end being joined to a set of radially extending legs, the top end being joined to a generally flat saddle configured to fit conformingly into said receptacle and to mate with said chair portion by way of said attachment mechanism in only one rotational orientation;

said article of furniture having a first configuration wherein the chair portion and the base saddle are securely joined by said attachment mechanism to provide a desk chair wherein said rail type legs do not contact a floor; and the furniture having a second configuration wherein the chair portion is manually released and physically separated by a user from said pedestal base and sits independently of said base with said rail type legs contacting said floor.

17. A convertible article of furniture as defined in claim 16 wherein said rail type legs are configured to provide at least two different pitch angles for said chair portion in said second configuration.

18. A multi-function task chair as defined in claim 1 wherein said rails are integral with at least a portion of said frame and extend fore-and-aft under said seat, and are configured to permit said chair, when said rails are resting on a floor, to assume multiple stable pitch angles.

19. An article of furniture as defined in claim 16 wherein the attachment mechanism includes a claw mounted on said chair adjacent the front of said receptacle to engage a notch in the front peripheral edge of said saddle.

* * * * *